US010746473B2

(12) United States Patent
Noishiki et al.

(10) Patent No.: US 10,746,473 B2
(45) Date of Patent: Aug. 18, 2020

(54) STACKED TYPE FLUID HEATER AND METHOD OF HEATING FLUID WITH STACKED TYPE FLUID HEATER

(71) Applicant: Kobe Steel, Ltd., Hyogo (JP)

(72) Inventors: Koji Noishiki, Takasago (JP); Yasutake Miwa, Takasago (JP)

(73) Assignee: Kobe Steel, Ltd., Hyogo (JP)

( * ) Notice: Subject to any disclaimer, the term of this patent is extended or adjusted under 35 U.S.C. 154(b) by 327 days.

(21) Appl. No.: 15/459,784

(22) Filed: Mar. 15, 2017

(65) Prior Publication Data

US 2017/0268826 A1 Sep. 21, 2017

(30) Foreign Application Priority Data

Mar. 17, 2016 (JP) ..... 2016-054034

(51) Int. Cl.
*F28D 9/00* (2006.01)

(52) U.S. Cl.
CPC ..... *F28D 9/005* (2013.01); *F28D 9/00* (2013.01); *F28D 9/0093* (2013.01); *F28F 2275/061* (2013.01)

(58) Field of Classification Search
CPC ..... F28D 9/005; F28D 9/00; F28D 9/0093; F28F 2275/061
See application file for complete search history.

(56) References Cited

U.S. PATENT DOCUMENTS

2006/0090887 A1* 5/2006 Kato ..... F28D 9/005 165/166
2010/0263823 A1* 10/2010 Mitsuhashi ..... F28D 9/0062 165/11.1
2011/0268616 A1* 11/2011 Noishiki ..... B01J 19/0093 422/129

(Continued)

FOREIGN PATENT DOCUMENTS

CN 105102800 A 11/2015
CN 105157456 A 12/2015

(Continued)

OTHER PUBLICATIONS

JP-2014152963-A translation.*

(Continued)

*Primary Examiner* — Jon T. Schermerhorn, Jr.
(74) *Attorney, Agent, or Firm* — Studebaker & Brackett PC

(57) ABSTRACT

A stacked type fluid heater includes a first low temperature layer with low temperature side flow passages into which target medium to be heated is introduced, a first high temperature layer with high temperature side flow passages into which heating medium for heating the target medium to be heated is introduced, a second high temperature layer with high temperature side flow passages into which the heating medium is introduced. The target medium has a temperature lower than the freezing point of the heating medium. The first high temperature layer includes the high temperature side flow passages located adjacent each other (Continued)

via a metal material of the first high temperature layer. The high temperature side flow passages of the first high temperature layer and those of the second high temperature layer are adjacent each other via a metal material of the second high temperature layer.

3 Claims, 6 Drawing Sheets

(56) References Cited

U.S. PATENT DOCUMENTS

| | | | | |
|---|---|---|---|---|
| 2012/0234755 | A1* | 9/2012 | Noishiki | B01F 5/0478 210/634 |
| 2015/0016076 | A1 | 1/2015 | Shimizu et al. | |
| 2015/0316326 | A1* | 11/2015 | Choi | F02M 21/0215 165/166 |
| 2015/0376742 | A1 | 12/2015 | Matsumoto et al. | |
| 2016/0131434 | A1 | 5/2016 | Noishiki et al. | |
| 2019/0285352 | A1 | 9/2019 | Choi | |

FOREIGN PATENT DOCUMENTS

| | | | | | |
|---|---|---|---|---|---|
| JP | S54114867 | U | | 8/1979 | |
| JP | H11-051578 | A | | 2/1999 | |
| JP | 2005-291546 | A | | 10/2005 | |
| JP | 2010-038330 | A | | 2/2010 | |
| JP | 2014152963 | A | * | 8/2014 | F25B 39/02 |
| JP | 2016503483 | A | | 2/2016 | |
| WO | 2014/122890 | A1 | | 8/2014 | |
| WO | 2015/016076 | A1 | | 2/2015 | |

OTHER PUBLICATIONS

The extended European search report issued by the European Patent Office dated Aug. 2, 2017, which corresponds to European Patent Application No. 17155969.3-1602 and is related to U.S. Appl. No. 15/459,784.

* cited by examiner

STACKED TYPE FLUID HEATER AND METHOD OF HEATING FLUID WITH STACKED TYPE FLUID HEATER

FIELD OF THE INVENTION

The present invention relates to a stacked type fluid heater and a method of heating a fluid with a stacked type fluid heater.

DESCRIPTION OF THE RELATED ART

Hitherto, fluid heaters for heating a fluid having a very low temperature, such as liquefied natural gas, have been known, for example, as disclosed in JP 2010-38330 A. The fluid heater disclosed in JP 2010-38330 A comprises a shell to which heating medium (warm water) is supplied, and heat exchanged tubes in plural lines arranged within the shell, to which a liquid fluid having a very low temperature such as a liquefied natural gas which is a target medium to be vaporized is supplied. Namely, the fluid heater is composed of a so-called shell-and-tube type heat exchanger. In this fluid heater, a liquid fluid having a very low temperature flowing within the heat exchanged tubes is heated with the heating medium around the heat exchanged tubes, and is vaporized.

SUMMARY OF THE INVENTION

In a configuration comprising plural lines of heat exchanged tubes as that of the fluid heater disclosed in JP 2010-38330 A, heating medium around the heat exchanged tubes may be cooled with the liquid fluid having a very low temperature flowing within the heat exchanged tubes, and be frozen in some cases. Heating medium once has started freezing becomes hard to flow around heat exchanged tubes, freezing easily developed, and gradually closing gaps between each heat exchanged tube. In such a condition, it becomes impossible to heat target medium to be heated with the heating medium, and therefore, it is necessary to melt the frozen heating medium. However, in a case of shell-and-tube type heat exchanger, there is a problem that operation of a fluid heater should be stopped, in order to melt the frozen heating medium.

The present invention has been achieved in view of the conventional technique, and a purpose of the invention is to make it possible to continue heating of target medium to be heated with heating medium, without stopping an operation of a fluid heater, even if there may be a case that the heating medium is frozen.

In order to achieve the purpose, the present invention is a stacked type fluid heater which comprises: a first low temperature layer on which a plural number of low temperature side flow passages is formed to introduce therein target medium to be heated; and a first high temperature layer adjacent to the first low temperature layer, on which a plural number of high temperature side flow passages is formed to introduce therein heating medium for heating the target medium to be heated, wherein a temperature of the target medium to be heated introduced into the plural number of low temperature side flow passages is lower than a freezing point of the heating medium; and the plural number of high temperature side flow passages comprises high temperature side flow passages adjacent to each other through a component of the first high temperature layer.

In the present invention, the plural number of high temperature side flow passages of the first high temperature layer comprises high temperature side flow passages adjacent to each other through a component of the first high temperature layer. Thus, heat of heating medium flowing through a high temperature side flow passage is transmitted to heating medium flowing through a high temperature side flow passage adjacent thereto, through the member which is a component of the first high temperature layer. That is to say, a region between the high temperature side flow passages in a component of the first high temperature layer easily maintains a high temperature. Therefore, even if a temperature of target medium to be heated is lower than a freezing point of heating medium, it is possible to make it easy to maintain a temperature of the heating medium to be equal to or higher than the freezing point. Even if a portion of heating medium flowing through a high temperature side flow passage starts freezing, it is possible to melt the heating medium that has started freezing by heat of heating medium flowing through a high temperature side flow passage adjacent thereto. Thus, it is possible to continue an operation of a stacked type fluid heater, even if there is a case where a portion of a heating fluid is frozen.

The first high temperature layer may be adjacent to a second high temperature layer on which a plural number of high temperature side flow passages is formed to introduce therein heating medium comprising the same fluid as the heating medium described above. In this case, the plural number of high temperature side flow passages of the first high temperature layer and the plural number of high temperature side flow passages of the second high temperature layer may be adjacent to each other, through at least one of a component of the first high temperature layer and a component of the second high temperature layer.

In this mode, heat of the heating medium flowing through the high temperature side flow passages of the second high temperature layer is transmitted to the heating medium flowing through the high temperature side flow passages in the first high temperature layer adjacent thereto, through at least one of a component of the first high temperature layer and a component of the second high temperature layer. In other words, a region between the high temperature side flow passages of the first high temperature layer and the high temperature side flow passages of the second high temperature layer easily maintains a high temperature, because the region is hard to be cooled by the target medium to be heated. Therefore, even if heating medium flowing through the high temperature side flow passages of the first high temperature layer is cooled with target medium to be heated in the low temperature side flow passages, it is possible to inhibit the heating medium from being frozen, because the heating medium is heated with the region between the high temperature side flow passages which maintains a high temperature.

The second high temperature layer may be adjacent to a second low temperature layer on which a plural number of low temperature side flow passages is formed to introduce therein target medium to be heated which comprises the same fluid as the target medium to be heated described above. In this mode, the heating medium flowing through the high temperature side flow passages of the second high temperature layer is cooled with target medium to be heated in the low temperature side flow passages of the second low temperature layer. However, it is possible to inhibit the heating medium flowing through the high temperature side flow passages of the second high temperature layer from being frozen, since the region between the high temperature side flow passages of the first high temperature layer and the high temperature side flow passages of the second high temperature layer maintains a high temperature.

The second high temperature layer may be adjacent to a third high temperature layer on which a plural number of high temperature side flow passages is formed to introduce therein heating medium comprising the same fluid as the heating medium described above. In this case, the plural number of high temperature side flow passages of the second high temperature layer and the plural number of high temperature side flow passages of the third high temperature layer may be adjacent to each other, through at least one of a component of the second high temperature layer and a component of the third high temperature layer.

In this mode, the third high temperature layer is laminated on the second high temperature layer. Namely, the second high temperature layer is sandwiched between the first high temperature layer and the third high temperature layer, and is not adjacent to the low temperature layer. Thus, the heating medium flowing through the high temperature side flow passages of the second high temperature layer heats heating medium flowing through the high temperature side flow passages of the first high temperature layer, and at the same time, heats heating medium flowing through the high temperature side flow passages of the third high temperature layer. Thus, it is possible, in a higher degree, to inhibit heating medium flowing through the high temperature side flow passages of the first high temperature layer and heating medium flowing through the high temperature side flow passages of the third high temperature layer from being frozen.

The third high temperature layer may have a second low temperature layer laminated thereon, on which a plural number of low temperature side flow passages is formed to introduce therein target medium to be heated comprising the same fluid as the target medium to be heated described above.

In this mode, the heating medium flowing through the high temperature side flow passages of the third high temperature layer is cooled with target medium to be heated in the low temperature side flow passages of the second low temperature layer. However, it is possible to inhibit the heating medium flowing through the high temperature side flow passages of the third high temperature layer from being frozen, since a region between the high temperature side flow passages of the second high temperature layer and the high temperature side flow passages of the third high temperature layer maintains a high temperature.

The stacked type fluid heater may comprise a high temperature side supply header that supplies heating medium to be introduced into the plural number of high temperature side flow passages of the first high temperature layer, and heating medium to be introduced into the plural number of high temperature side flow passages of the second high temperature layer.

In this mode, for example, in a case that a portion of heating medium flowing through the high temperature side flow passages of the first high temperature layer is frozen, flow passage resistance of the high temperature side flow passages is increased. Accordingly, for the heating medium supplied from the high temperature side supply header, it becomes easier to flow through the high temperature side flow passages of the second high temperature layer. Thus, it is possible to heat heating fluid flowing through the high temperature side flow passages of the first high temperature layer in a higher degree, with heating medium flowing through the high temperature side flow passages of the second high temperature layer. Thus, it is possible to automatically adjust a supplying flow amount of heating medium to the high temperature side flow passages, without additionally providing a means for adjusting the supplying flow amount.

The stacked type fluid heater may comprise a first high temperature side supply header that supplies heating medium to the plural number of high temperature side flow passages of the first high temperature layer, a second high temperature side supply header that supplies heating medium to the plural number of high temperature side flow passages of the second high temperature layer, and an adjustment unit that adjusts a supplying proportion to the first high temperature side supply header and to the second high temperature side supply header.

In this mode, it is possible to adjust flow amount of heating medium supplied to the high temperature side flow passages of the first high temperature layer and flow amount of heating medium supplied to the high temperature side flow passages of the second high temperature layer with the adjustment unit. Accordingly, even in a case where a portion of heating medium is frozen, it is possible to continue operation of the stacked type fluid heater, by adjusting supplying amount to the high temperature side flow passages, for example, on the basis of a pressure loss in the high temperature side flow passages, or the like.

A temperature of the target medium to be heated to be introduced to the plural number of low temperature side flow passages may be −40° C. or less.

The present invention relates to a method of heating a fluid by a stacked type fluid heater, which uses a stacked type fluid heater that comprises a first low temperature layer and a first high temperature layer adjacent to the first low temperature layer, wherein target medium to be heated is introduced into a plural number of low temperature side flow passages formed on the first low temperature layer of the stacked type fluid heater; heating medium is introduced into a plural number of high temperature side flow passages formed on the first high temperature layer, such that high temperature side flow passages adjacent to each other through a component of the first high temperature layer are included; the target medium to be heated flowing through the low temperature side flow passages is heated with the heating medium; with a temperature of the target medium to be heated introduced to the plural number of low temperature side flow passages being lower than a freezing point of the heating medium.

In the method of heating a fluid with the stacked type fluid heater, heating medium may be introduced also to the plural number of high temperature side flow passages formed on the second high temperature layer of the stacked type fluid heater, so as to be adjacent to the plural number of high temperature side flow passages of the first high temperature layer through at least one of a component of the first high temperature layer and a component of the second high temperature layer.

In this heating method, it is possible to heat heating medium flowing through the high temperature side flow passages of the first high temperature layer, with heating medium flowing through the high temperature side flow passages of the second high temperature layer. This heating medium flowing through the high temperature side flow passages of the first high temperature layer can heat target medium to be heated flowing through the low temperature side flow passages.

In the method of heating a fluid with the stacked type fluid heater, heating medium may be introduced also to the plural number of high temperature side flow passages formed on the third high temperature layer of the stacked type fluid heater, so as to be adjacent to the plural number of high temperature side flow passages of the second high temperature layer through at least one of a component of the second high temperature layer and a component of the third high temperature layer.

In this heating method, the heating medium flowing through the high temperature side flow passages of the second high temperature layer is hard to be cooled, since the high temperature side flow passages of the second high temperature layer and the high temperature side fluid of the third high temperature layer are adjacent to each other through a component of the second high temperature layer and a component of the third high temperature layer. By this heating medium flowing through the high temperature side flow passages of the second high temperature layer, it is possible to heat heating medium flowing through the high temperature side flow passages of the first high temperature layer. Then, by this heating medium flowing through the high temperature side flow passages of the first high temperature layer, it is possible to heat target medium to be heated flowing through the low temperature side flow passages.

In the method of heating a fluid with the stacked type fluid heater, the heating medium may be supplied from the same supply header, to the plural number of high temperature side flow passages of the first high temperature layer, and to the plural number of high temperature side flow passages of the second high temperature layer.

In this heating method, for example, in a case that a portion of heating medium flowing through the high temperature side flow passages of the first high temperature layer is frozen, flowing resistance of the heating medium in the high temperature side flow passages is increased.

Accordingly, for heating medium supplied from the supply header, it becomes easier to flow through the high temperature side flow passages of the second high temperature layer. Therefore, it is possible to heat heating fluid flowing through the high temperature side flow passages of the first high temperature layer in a higher degree, with heating medium flowing through the high temperature side flow passages of the second high temperature layer. Thus, it is possible to automatically adjust a supplying flow amount of heating medium to the high temperature side flow passages, without additionally providing a means for adjusting the supplying flow amount.

In the method of heating a fluid with the stacked type fluid heater, heating medium may be supplied from different supply headers, to the plural number of high temperature side flow passages of the first high temperature layer, and to the plural number of high temperature side flow passages of the second high temperature layer, with adjusting supplying proportion of the heating medium to these supply headers.

In this heating method, it is possible to adjust the flow amount of heating medium to be supplied to the high temperature side flow passages of the first high temperature layer and flow amount of heating medium supplied to the high temperature side flow passages of the second high temperature layer. Accordingly, even in a case where a portion of heating medium is frozen, it is possible to continue operation of the stacked type fluid heater, by adjusting supplying amount to the high temperature side flow passages, for example, on the basis of a pressure loss of a high temperature side flow passage, or the like. It is also possible to controlling the temperature of heating medium to be supplied to each of the flow passages, to allow an efficient heating.

As described above, according to the present invention, even if there may be a case where heating medium is frozen, it is possible to continue heating of target medium to be heated with heating medium, without stopping operation of a fluid heater.

DESCRIPTION OF THE PREFERRED EMBODIMENTS

Hereinbelow, embodiments for implementing the present invention will be described in detail, with reference to the drawings.

First Embodiment

Figure 1:
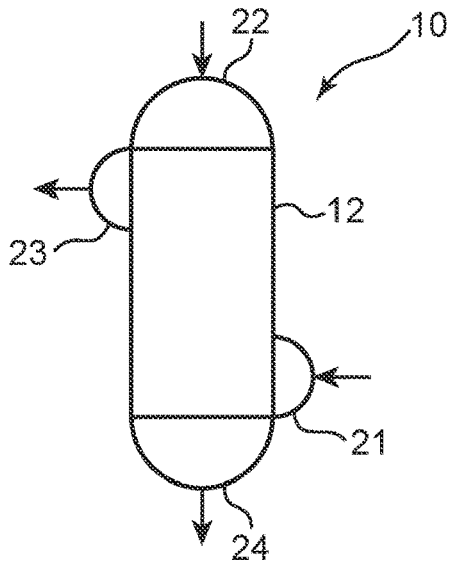
FIG. 1 is a diagram schematically showing a stacked type fluid heater according to a first embodiment of the present invention.
Figure 2:
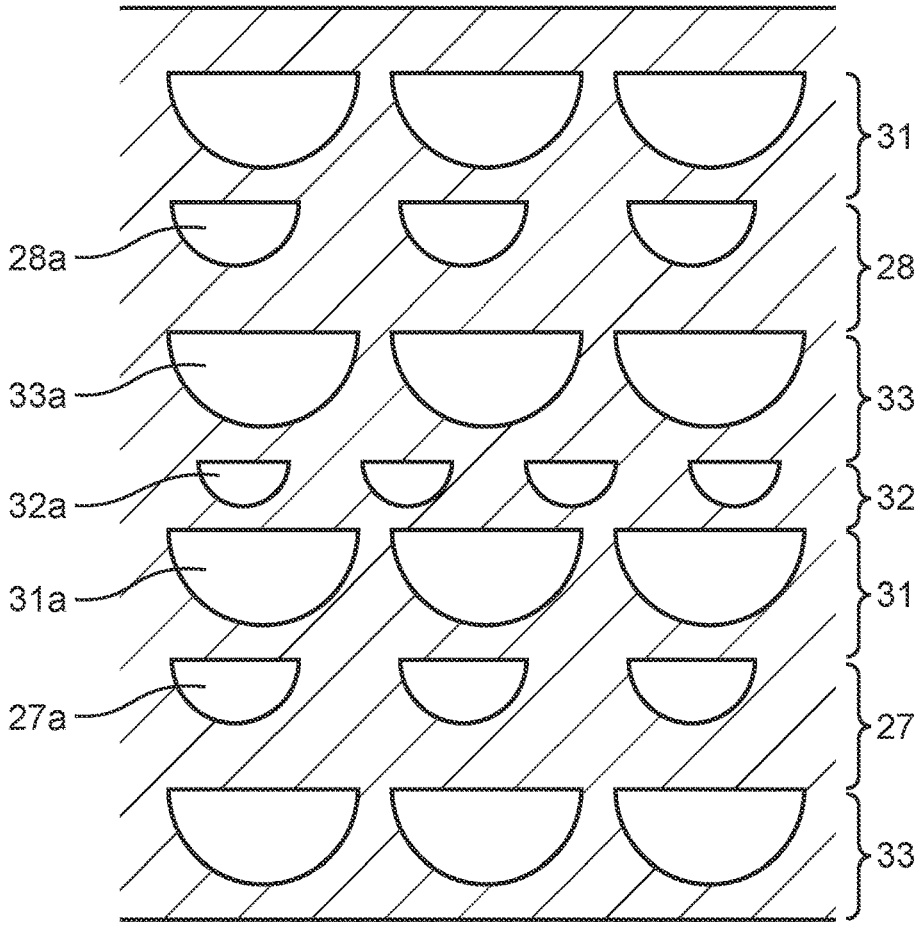
FIG. 2 is a sectional view of a main part of a laminate installed in the stacked type fluid heater.

As shown in FIG. 1, a stacked type fluid heater 10 according to a first embodiment comprises a laminate 12 with a structure in which a low temperature layer (a low temperature area) and a high temperature layer (a high temperature area) are adjacent to each other; and headers 21, 22, 23 and 24 fixed to the laminate 12. As shown in FIG. 2, the low temperature layer comprises a first low temperature layer (a first low temperature area) 27 and a second low temperature layer (a second low temperature area) 28. The first low temperature layer 27 and the second low temperature layer 28 are provided with a plural number of low temperature side flow passages 27*a* and 28*a* to which target medium to be heated is introduced. The high temperature layer comprises a first high temperature layer (a first high temperature area) 31, a second high temperature layer (a second high temperature area) 32 and a third high temperature layer (a third high temperature area) 33. On these layers 31, 32 and 33, a plural number of high temperature side flow passages 31*a*, 32*a* and 33*a* are formed respectively to introduce therein heating medium for heating target medium to be heated. Examples for the target medium to be heated may include liquefied gases having a very low temperature, such as liquefied natural gases, liquefied nitrogen, liquefied hydrogen and the like; and gases with a low temperature such as methane gas, ethane gas, propane gas and the like.

Examples for the heating medium may include liquid fluids such as warm water, seawater, ethylene glycol and the like. However, the target medium to be heated and the heating medium are in a relationship that a temperature of the target medium to be heated is lower than a freezing point of the heating medium. Therefore, there can be a case where the heating medium is cooled with the target medium to be heated, and a as result, the heating medium is partially frozen. A temperature of the target medium to be heated before introduced into the laminate 12 may be, for example, −40° C. or less which will be a freezing point of glycol water (50 wt %). The temperature may also be −100° C. or less. Alternatively, the target medium to be heated may also be a fluid having a temperature of −40° C. or higher, or, for example, a fluid which has reached a supercritical state.

Provided as the headers are: a low temperature side supply header 21 which distributes the target medium to be heated to the plural number of low temperature side flow passages 27*a* and 28*a*; a high temperature side supply header 22 which distributes the heating medium to the plural number of high temperature side flow passages 31*a*, 32*a* and 33*a*; a low temperature side assembler header 23 which merges the target medium to be heated which has flown through the plural number of low temperature side flow passages 27*a* and 28*a*; and a high temperature side assembler header 24 which merges the heating medium which has flown through the plural number of high temperature side flow passages 31*a*, 32*a* and 33*a*.

The stacked type fluid heater 10 comprises a so-called microchannel heat exchanger, as will be described below.

The low temperature layer comprises the first low temperature layer 27 and the second low temperature layer 28. The first low temperature layer 27 and the second low temperature layer 28 are each made of a metal material having a high heat conductivity. A plural number of low temperature side flow passages 27*a* and 28*a* are formed on the first low temperature layer 27 and the second low temperature layer 28, respectively. In other words, the first low temperature layer 27 is formed as a flat area comprising the plural number of low temperature side flow passages 27*a*. The second low temperature layer 28 is formed as a flat area comprising the plural number of low temperature side flow passages 28*a*.

As will be described later, the first low temperature layer 27 and the second low temperature layer 28 are each formed by subjecting metal plates together to diffusion bonding. The low temperature side flow passages 27*a* and 28*a* are each formed by disposing grooves with intervals from each other on one of the faces of the metal plates before the diffusion bonding. Accordingly, each of the low temperature side flow passages 27*a* has an inner peripheral surface configured to have a curved shape, and a flat inner peripheral surface which links both ends of the inner peripheral surface together. Further, the low temperature side flow passages 27*a* are arranged side by side such that the flat inner peripheral surfaces define a plane. The low temperature side flow passages 28*a* of the second low temperature layer 28 are the same as described above.

The high temperature layer comprises the first high temperature layer 31, the second high temperature layer 32 and the third high temperature layer 33. The first high temperature layer 31, the second high temperature layer 32 and the third high temperature layer 33 each comprise a metal material having a high heat conductivity. A plural number of high temperature side flow passages 31*a*, 32*a* and 33*a* is formed on the first high temperature layer 31, the second high temperature layer 32 and the third high temperature layer 33, respectively. In other words, the first high temperature layer 31 is formed as a flat area comprising the plural number of high temperature side flow passages 31*a*. The second high temperature layer 32 is formed as a flat area comprising the plural number of high temperature side flow passages 32*a*. The third high temperature layer 33 is formed as a flat area comprising the plural number of high temperature side flow passages 33*a*.

As will be described later, all of the first high temperature layer 31, the second high temperature layer 32 and the third high temperature layer 33 are each formed by subjecting metal plates together to diffusion bonding. The high temperature side flow passages 31*a*, 32*a* and 33*a* are each formed by disposing grooves with intervals from each other on one of the faces of the metal plates before the diffusion bonding. Accordingly, each of the high temperature side flow passages 31*a*, 32*a* and 33*a* has an inner peripheral surface configured to have a curved shape, and a flat inner peripheral surface which links both ends of the inner peripheral surface. Then, each of the high temperature side flow passages 31*a*, 32*a* and 33*a* is arranged such that the flat inner peripheral surfaces define a plane. The high temperature side flow passages 31*a* of the first high temperature layer 31 comprises the high temperature side flow passages 31*a* adjacent to each other through a component of the first high temperature layer 31 interposed therebetween. The high temperature side flow passages 32*a* of the second high temperature layer 32 and the high temperature side flow passages 33*a* of the third high temperature layer 33 are the same as described above.

One of the sides of the first low temperature layer 27 (the upper side in FIG. 2) is adjacent to the first high temperature layer 31, and the second high temperature layer 32, the third high temperature layer 33 and the second low temperature layer 28 are adjacent one to the next in this order. That is to say, the first high temperature layer 31, the second high temperature layer 32 and the third high temperature layer 33 are disposed between the first low temperature layer 27 and the second low temperature layer 28. The metal plates for forming each of the layers 27, 31, 32, 33 and 28 are joined together by diffusion bonding. Therefore, there is no border remaining between the adjacent layers. Namely, the laminate 12 has a structure in which the first low temperature layer 27 comprising an area having the plural number of low temperature side flow passages 27*a* arranged therein, and the first high temperature layer 31 comprising an area having the plural number of high temperature side flow passages 31*a* arranged therein are adjacent to each other without clearly having a border therebetween. The other layers are the same as described above.

As used herein, the diffusion bonding refers to a method in which metal plates are closely joined to each other, then a pressure is applied to the plates under a condition of temperature equal to or lower than a melting point of a material which is a component of the metal plates, in a degree that would cause a minimum plastic deformation, and diffusion of atoms generated between surfaces being joined to each other is used to join the metal plates to each other. Therefore, there is no border apparently appearing between the adjacent layers. In this connection, each layer is not limited to those joined by diffusion bonding. In that case, a border between the layers may appear.

The first high temperature layer 31 faces a surface on which the low temperature side flow passages 27*a* are formed (a virtual plane including the flat inner peripheral surfaces of the low temperature side flow passages 27*a*) in a metal plate which is a component of the first low temperature layer 27. The high temperature side flow passages 31*a* of the first high temperature layer 31 are formed on a surface facing opposite to the first low temperature layer 27 in the metal plate which is a component of the first high temperature layer 31. Namely, the high temperature side flow passages 31*a* are positioned in the side closer to the second high temperature layer 32 than to the first low temperature layer 27 in the first high temperature layer 31. Therefore, heat of heating medium flowing through the high temperature side flow passages 31*a* of the first high temperature layer 31 is transmitted to target medium to be heated flowing through the low temperature side flow passages 27*a* of the first low temperature layer 27, with a metal material which is a component of the first high temperature layer 31. In other words, heating medium flowing through the first high temperature layer 31 is cooled with target medium to be heated flowing through a low temperature side flow passages 27*a* of the first low temperature layer 27, with a metal material which is a component of the first high temperature layer 31.

The second high temperature layer 32 faces a surface on which the high temperature side flow passages 31*a* are formed (a virtual plane including the flat inner peripheral surfaces of the high temperature side flow passages 31*a*) in a metal plate which is a component of the first high temperature layer 31. The high temperature side flow passages 32*a* of the second high temperature layer 32 are formed on a surface facing opposite to the first high temperature layer 31 in the metal plate which is a component of the second high temperature layer 32. Namely, the high temperature side flow passages 32*a* are positioned in the side closer to the third high temperature layer 33 than to the first high temperature layer 31 in the second high temperature layer 32. Accordingly, the plural number of high temperature side flow passages 31*a* of the first high temperature layer 31 and the plural number of high temperature side flow passages 32*a* of the second high temperature layer 32 are adjacent to each other with a metal material, which is a component of the second high temperature layer 32, being interposed therebetween. Thus, heat of heating medium flowing through the high temperature side flow passages 32*a* of the second high temperature layer 32 is transmitted to heating medium flowing through the high temperature side flow passages 31*a* of the first high temperature layer 31 with a metal material which is a component of the second high temperature layer 32.

The third high temperature layer 33 faces a surface on which the high temperature side flow passages 32*a* are formed (a virtual plane including the flat inner peripheral surfaces of the high temperature side flow passages 32*a*) in a metal plate which is a component of the second high temperature layer 32. The third high temperature layer 33 faces a surface in the opposite side of the surface on which the low temperature side flow passage 28*a* are formed, in the metal plate which is a component of the second low temperature layer 28.

The high temperature side flow passages 33*a* of the third high temperature layer 33 are formed on a surface facing opposite to the second high temperature layer 32 in the metal plate which is a component of the third high temperature layer 33, namely, on a surface facing the second low temperature layer 28 in the metal plate which is a component of the third high temperature layer 33. Namely, the high temperature side flow passages 33*a* are positioned in the side closer to the second low temperature layer 28 than to the second high temperature layer 32 in the third high temperature layer 33. Accordingly, the plural number of high temperature side flow passages 32*a* of the second high temperature layer 32 and the plural number of high temperature side flow passages 33*a* of the third high temperature layer 33 are adjacent to each other with a metal material, which is a component of the third high temperature layer 33, being interposed therebetween. Thus, heat of heating medium flowing through the second high temperature layer 32 is transmitted also to a heating member flowing through a high temperature side flow passage 33*a* of the third high temperature layer 33 with a metal material which is a component of the third high temperature layer 33.

The low temperature side flow passages 28*a* of the second low temperature layer 28 are formed on a surface facing opposite to the third high temperature layer 33 in a metal plate which is a component of the second low temperature layer 28. Namely, the low temperature side flow passages 28*a* are positioned in the side closer to the first high temperature layer 31 than to the third high temperature layer 33 in the second low temperature layer 28. Accordingly, the plural number of high temperature side flow passages 33*a* of the third high temperature layer 33 and the plural number of low temperature side flow passages 28*a* of the second low temperature layer 28 are adjacent to each other with a metal material, which is a component of the second low temperature layer 28, being interposed therebetween. Thus, heat of heating medium flowing through the high temperature side flow passages 33*a* of the third high temperature layer 33 is transmitted to target medium to be heated flowing through the low temperature side flow passages 28*a* of the second low temperature layer 28 with a metal material which is a component of the second low temperature layer 28. In other words, heating medium flowing through the third high temperature layer 33 is cooled with target medium to be heated flowing through the low temperature side flow passages 28*a* of the second low temperature layer 28 with a metal material which is a component of the second low temperature layer 28.

The first high temperature layer 31 has a completely identical structure with the third high temperature layer 33. A metal plate which is a component of the second high temperature layer 32 is formed to be thinner than a metal plate which is a component of the first high temperature layer 31. The high temperature side flow passages 32*a* of the second high temperature layer 32 are formed to have a smaller sectional area than that of the high temperature side flow passages 31*a* of the first high temperature layer 31. The relationship in thickness between the metal plates and the relationship in sectional area between the flow passages are not limited to those described above, and may be reversed.

Although not illustrated, end plates are disposed on both ends in the lamination direction of the high temperature layer and the low temperature layer in the laminate 12, respectively, in such a configuration that the laminate 12 is sandwiched by the end plates.

Figures 3A, 3B, 3C:
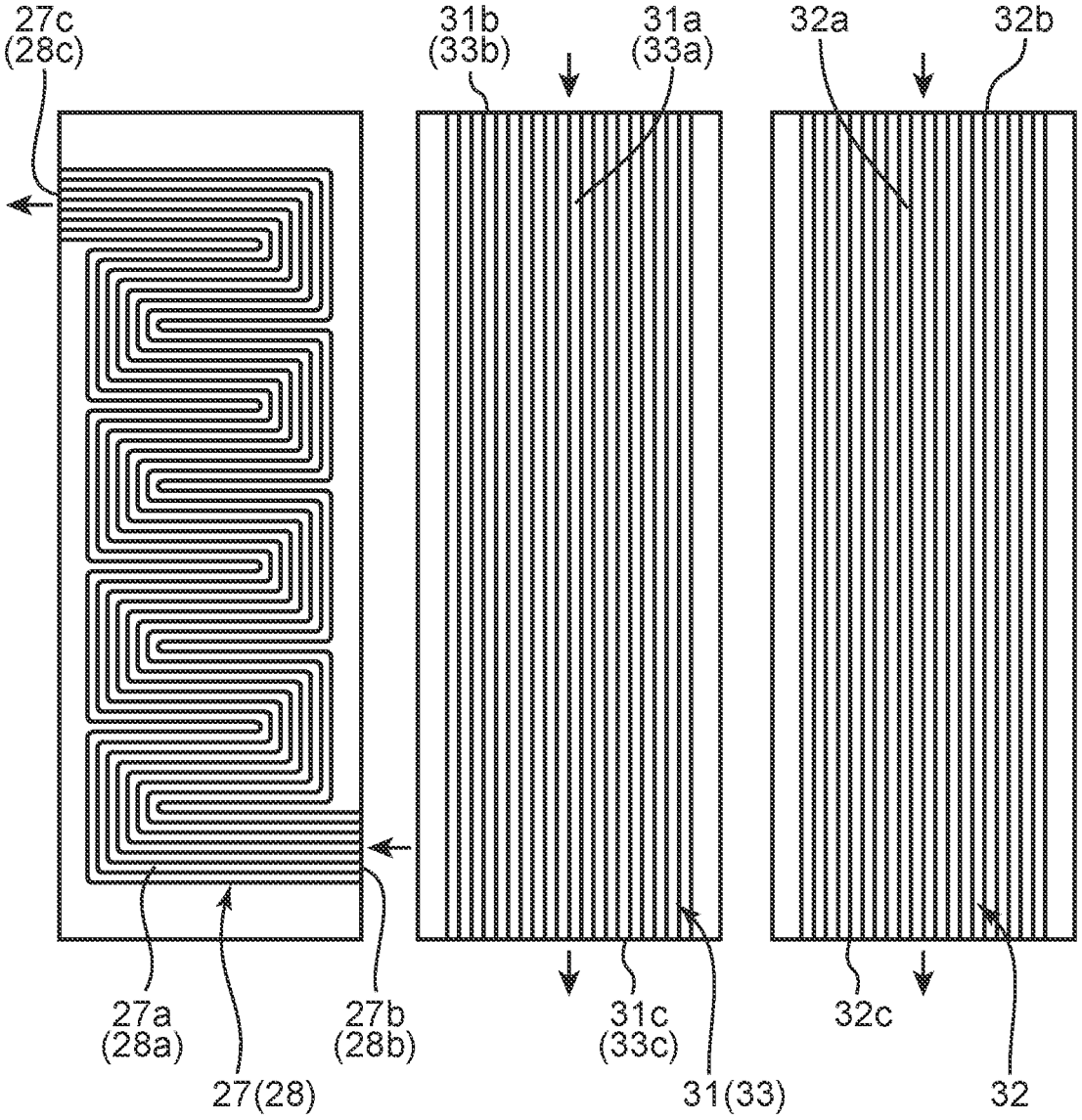
FIG. 3A is a diagram showing a structure of a metal plate for forming a first low temperature layer.
FIG. 3B is a diagram showing a structure of a metal plate for forming a first high temperature layer.
FIG. 3C is a diagram showing a structure of a metal plate for forming a second high temperature layer.

As shown in FIG. 3A, the low temperature side flow passages 27*a* (28*a*) of the first low temperature layer 27 (the second low temperature layer 28) are formed into a zigzag shape. In addition, an inlet (an end portion) 27*b* (28*b*) of the low temperature side flow passage 27*a* (28*a*) opens in an inside space of the low temperature side supply header 21, and an outlet (the other end portion) 27*c* (28*c*) of the low temperature side flow passage 27*a* (28*a*) opens in an inside space of the low temperature side assembler header 23. Therefore, target medium to be heated in the low temperature side supply header 21 flows into the low temperature side flow passages 27*a* and 28*a* of the first low temperature layer 27 and the second low temperature layer 28. Then, the target medium to be heated which has flown through the low temperature side flow passages 27*a* and 28*a* of the first low temperature layer 27 and the second low temperature layer 28 flow into the low temperature side assembler header 23. Shapes of the low temperature side flow passages 27*a* and 28*a* each are not limited to a zigzag shape, but various shapes may be adopted. As a shape of each flow passage, various shapes may be adopted, such as straight flow passages or waveform flow passages.

The high temperature side flow passages 31*a* (33*a*) of the first high temperature layer 31 (the third high temperature layer 33) are formed into a linear shape, as shown in FIG. 3B. The high temperature side flow passages 32*a* of the second high temperature layer 32 are also formed into a linear shape, as shown in FIG. 3C. In addition, inlets (end portions) 31*b*, 32*b* and 33*b* of the high temperature side flow passages 31*a*, 32*a* and 33*a* all open in an inside space of the high temperature side supply header 22, and outlets (the other end portions) 31*c*, 32*c* and 33*c* of the high temperature side flow passages 31*a*, 32*a* and 33*a* all open in an inside space of the high temperature side assembler header 24. Accordingly, the heating medium in the high temperature side supply header 22 separately flows through the first high temperature layer 31 to the high temperature side flow passages 33*a* of the third high temperature layer 33. Then, the heating medium which has flown through the first high temperature layer 31 to the high temperature side flow passages 33*a* of the third high temperature layer 33 flows into the high temperature side assembler header 24. Each shape of the high temperature side flow passages 31*a*, 32*a* and 33*a* is not limited to the linear shape, and various shapes may be adopted. As a shape of each flow passage, various shapes may be adopted, such as straight flow passages or waveform flow passages.

In the stacked type fluid heater 10 of the first embodiment, heating medium is introduced from the high temperature side supply header 22 into the high temperature side flow passages 31*a* of the first high temperature layer 31, the high temperature side flow passages 32*a* of the second high temperature layer 32 and the high temperature side flow passages 33*a* of the third high temperature layer 33. On the other hand, target medium to be heated is introduced from the low temperature side supply header 21 into the low temperature side flow passages 27*a* of the first low temperature layer 27 and the low temperature side flow passages 28*a* of the second low temperature layer 28. Then, the heating medium flowing through each of the high temperature side flow passages 31*a*, 32*a* and 33*a* heats the target medium to be heated flowing through the low temperature side flow passages 27*a* and 28*a*. In this manner, a liquefied gas having a very low temperature is vaporized. The vaporized gas that has flown through each of the low temperature side flow passages 27*a* and 28*a* is assembled to the low temperature side assembler header 23. Meanwhile, the heating medium that has flown through each of the high temperature side flow passages 31*a*, 32*a* and 33*a* is assembled to the high temperature side assembler header 24.

Figure 4:
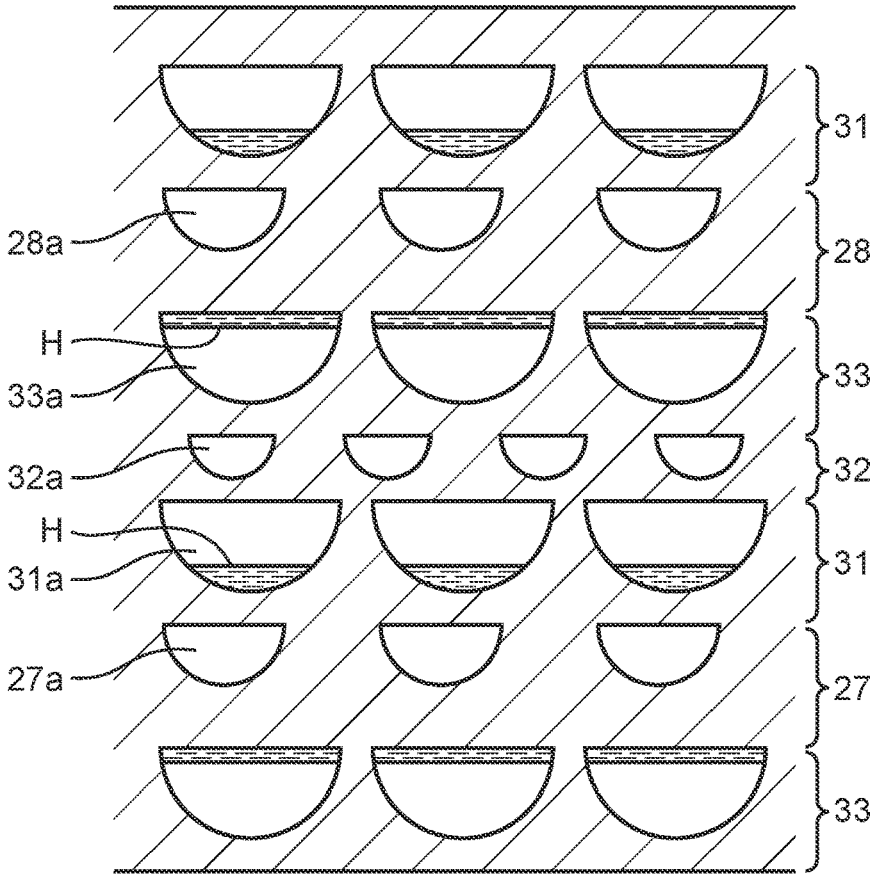
FIG. 4 is a diagram corresponding to FIG. 2, showing a portion of heating medium in a frozen state.

In the high temperature side flow passages 31*a* of the first high temperature layer 31, a portion of the heating medium (shown by sign H) may be frozen in the side closer to the first low temperature layer 27, as shown in FIG. 4. In the high temperature side flow passages 33*a* of the third high temperature layer 33, a portion of the heating medium (shown by sign H) may be frozen in a part thereof in contact with the second low temperature layer 28. Also in this case, the heating medium in the first high temperature layer 31 is heated with the heating medium in the second high temperature layer 32. Therefore, in the high temperature side flow passages 31*a* of the first high temperature layer 31, heating medium is hard to be frozen in the side closer to the second high temperature layer 32 or in a part in contact with the second high temperature layer 32.

Figure 5:
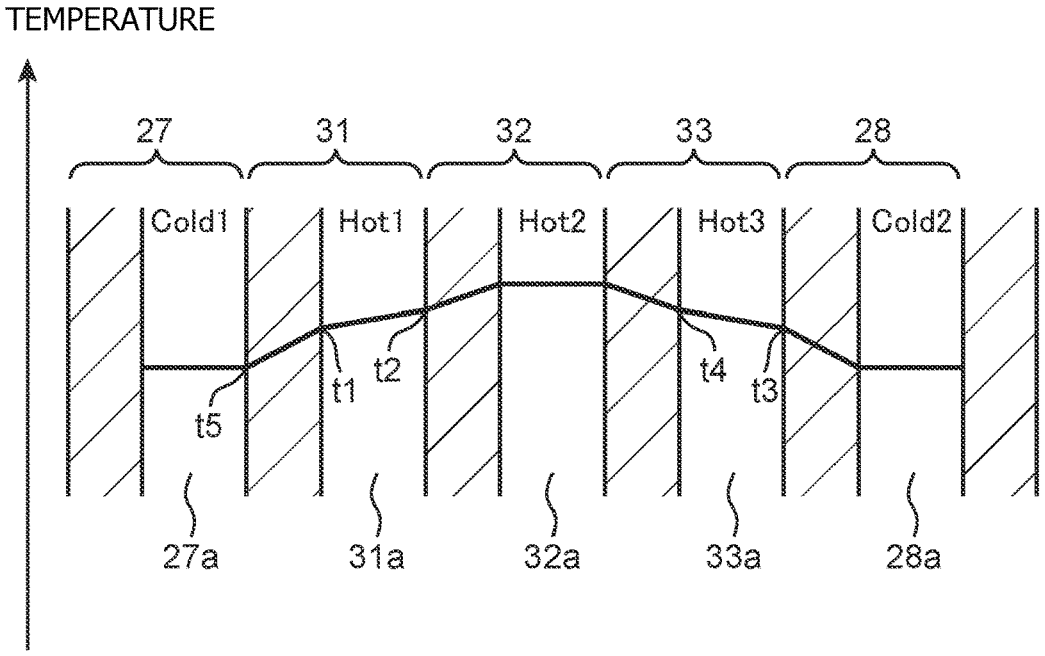
FIG. 5 is a diagram to describe a temperature distribution within the laminate.

Namely, as shown in FIG. 5, in the high temperature side flow passages 31*a* of the first high temperature layer 31, temperature t1 in the side closer to the first low temperature layer 27 is lower than temperature t2 in the side closer to the second high temperature layer 32. In the high temperature side flow passages 33*a* of the third high temperature layer 33, temperature t3 in the side closer to the second low temperature layer 28 is lower than temperature t4 in the side closer to the second high temperature layer 32. Therefore, in the first high temperature layer 31, a portion of the heating medium may be frozen in the side closer to the first low temperature layer 27, in some cases. Also, in the third high temperature layer 33, a portion of the heating medium may be frozen in the side closer to the second low temperature layer 28, in some cases. However, the temperature t2 of the member (metal plate) of a side wall of the first high temperature layer 31, said side wall being on the side of the second high temperature layer 32 located adjacent the high temperature side flow passages 31*a* of the first high temperature layer 31 is higher than the temperature t5 of the member (metal plate) of a side wall of the first high temperature layer 31, said side wall being on the side of the first low temperature layer 27. Therefore, it is hardly induced to freeze the heating medium such that the first high temperature layer 31 and the high temperature side flow passage 33*a* (hot1) of the third high temperature layer 33 would be blocked.

Although FIG. 4 shows a state in which freezing of heating medium occurs in all of the high temperature side flow passages 31*a*, 32*a* and 33*a* of the high temperature layers 31, 32 and 33, there can be a case where freezing of heating medium occurs in some of the high temperature side flow passages 31*a*, 32*a* and 33*a*. In this case, the smaller an area of the high temperature side flow passages 31*a*, 32*a* and 33*a* becomes due to the freezing, the higher a flow passage resistance becomes. Accordingly, the high temperature side flow passages 31*a*, 32*a* and 33*a* which have had no freezing and the high temperature side flow passages 31*a*, 32*a* and 33*a* having a smaller amount of freezing will have a larger flow amount of the heating medium. This facilitates heating the high temperature side flow passage 31*a*, 32*a* and 33*a* having a larger amount of freezing with the high temperature side flow passages 31*a*, 32*a* and 33*a* having a smaller amount of freezing.

As described above, in the present embodiment, the plural number of high temperature side flow passages 31*a* of the first high temperature layer 31 includes those which are adjacent to each other via a component of the first high temperature layer 31. This allows heat of heating medium flowing through a high temperature side flow passage 31*a* to be transmitted to the heating medium flowing through a high temperature side flow passage 31*a* adjacent thereto, through a component of the first high temperature layer 31. That is to say, a region between the high temperature side flow passages 31*a* in a component of the first high temperature layer 31 easily maintains a high temperature. Therefore, even if a temperature of target medium to be heated is lower than a freezing point of heating medium, it is possible to facilitate maintaining a temperature of the heating medium to be equal to or higher than the freezing point. Even if a portion of the heating medium flowing through a high temperature side flow passage 31*a* starts freezing, it is possible to melt the heating medium that has started freezing, with heat of the heating medium flowing through a high temperature side flow passage 31*a* adjacent thereto. Thus, it is possible to continue an operation of a stacked type fluid heater 10, even if there is a case where a portion of a heating fluid is frozen.

In the present embodiment, heat of the heating medium flowing through the high temperature side flow passages 32*a* of the second high temperature layer 32 is transmitted to the heating medium flowing through the high temperature side flow passages 31*a* of the first high temperature layer 31 adjacent thereto, through a component of the second high temperature layer 32. In other words, a region between the high temperature side flow passages 31*a* of the first high temperature layer 31 and the high temperature side flow passages 32*a* of the second high temperature layer 32 easily maintains a high temperature, because the region is hard to be cooled with the target medium to be heated. Therefore, even if heating medium flowing through the high temperature side flow passages 31*a* of the first high temperature layer 31 is cooled with the target medium to be heated in the low temperature side flow passages 27*a* or 28*a*, it is possible to inhibit the heating medium from being frozen, because the heating medium is heated with a portion between the high temperature side flow passages 31*a*, 32*a* and 33*a* which maintains a high temperature.

Besides, in the present embodiment, the second high temperature layer 32 is adjacent to the third high temperature layer 33. That is, the second high temperature layer 32 is sandwiched between the first high temperature layer 31 and the third high temperature layer 33, and is not adjacent to the low temperature layer 27 or 28. Thus, the heating medium flowing through the high temperature side flow passages 32*a* of the second high temperature layer 32 heats the heating medium flowing through the high temperature side flow passages 33*a* of the third high temperature layer 33, and at the same time, heats the heating medium flowing through the high temperature side flow passages 33*a* of the third high temperature layer 33. Thus, it is possible to inhibit the heating medium flowing through the high temperature side flow passages 31*a* of the first high temperature layer 31 and the heating medium flowing through the high temperature side flow passages 33*a* of the third high temperature layer 33 from being frozen.

In addition, in the present embodiment, the heating medium flowing through the high temperature side flow passages 33*a* of the third high temperature layer 33 is cooled with target medium to be heated in the low temperature side flow passages 28*a* of the second low temperature layer 28. However, it is possible to inhibit the heating medium flowing through the high temperature side flow passages 33*a* of the third high temperature layer 33, since a region between the high temperature side flow passages 32*a* of the second high temperature layer 32 and the high temperature side flow passages 33*a* of the third high temperature layer 33 maintains a high temperature.

In the present embodiment, for example, in a case that a portion of heating medium flowing through the high temperature side flow passages 31*a* of the first high temperature layer 31 is frozen, flow passage resistance of the high temperature side flow passages 31*a* is increased. Accordingly, for the heating medium supplied from the high temperature side supply header 22, it becomes easier to flow through the high temperature side flow passages 32*a* of the second high temperature layer 32. Therefore, it is possible to heat heating fluid flowing through the high temperature side flow passages 31*a* of the first high temperature layer 31 in a higher degree, with the heating medium flowing through the high temperature side flow passages 32*a* of the second high temperature layer 32. Thus, it is possible to automatically adjust a supplying flow amount of heating medium to the high temperature side flow passages 31*a*, 32*a*, 33*a*, without additionally providing a means for adjusting the supplying flow amount.

In this connection, although the first embodiment has a structure in which the high temperature side flow passages 31*a*, 32*a* and 33*a* are formed in the upper side of each of the high temperature layers 31, 32 and 33 in FIG. 2, and the low temperature side flow passages 27*a* and 28*a* are formed in the upper side of each of the low temperature layers 27 and 28 in FIG. 2, the structure is not limited thereto. The structure may be such that the high temperature side flow passages 31*a*, 32*a* and 33*a* are formed in the lower side of each of the high temperature layers 31, 32 and 33 in FIG. 2, and the low temperature side flow passages 27*a* and 28*a* are formed in the lower side of each of the low temperature layers 27 and 28 in FIG. 2. In this case, the plural number of high temperature side flow passages 31*a* of the first high temperature layer 31 and the plural number of high temperature side flow passages 32*a* of the second high temperature layer 32 will be adjacent to each other through a member (metal material) which is a component of the first high temperature layer 31. In addition, the plural number of high temperature side flow passages 32*a* of the second high temperature layer 32 and the plural number of high temperature side flow passages 33*a* of the third high temperature layer 33 will be adjacent to each other through a member (metal material) which is a component of the second high temperature layer 32.

The plural number of high temperature side flow passages 31*a* of the first high temperature layer 31 and the plural number of high temperature side flow passages 32*a* of the second high temperature layer 32 may be configured to be adjacent to each other through a component of the first high temperature layer 31 and a component of the second high temperature layer 32. Besides, the plural number of high temperature side flow passages 32*a* of the second high temperature layer 32 and the plural number of high temperature side flow passages 33*a* of the third high temperature layer 33 may be configured to be adjacent to each other through a component of the second high temperature layer 32 and a component of the third high temperature layer 33.

Second Embodiment

Figure 6:
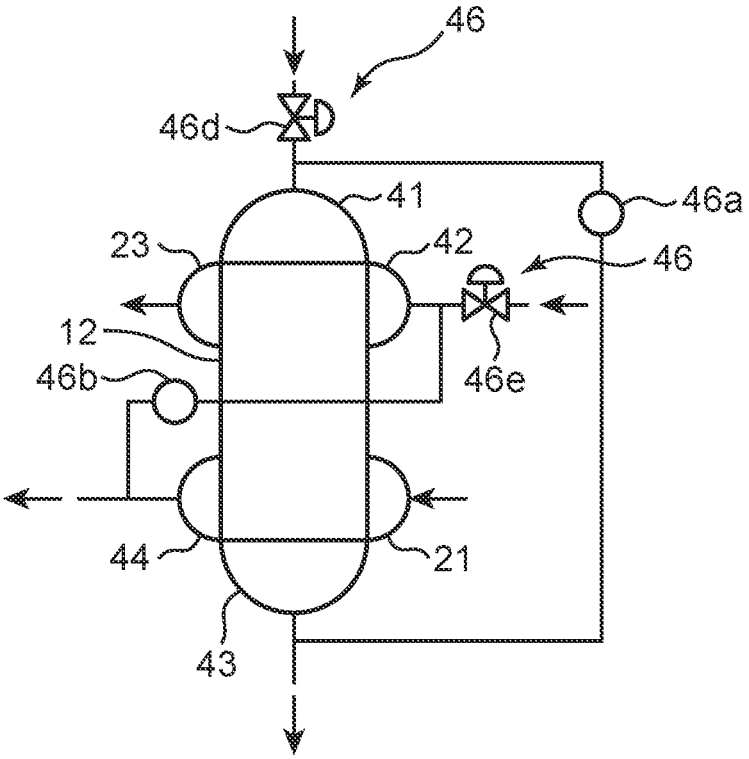
FIG. 6 is a diagram schematically showing the stacked type fluid heater according to a second embodiment of the present invention.

FIG. 6 shows a second embodiment of the present invention. Here, the same signs will be assigned to the same components as those in the first embodiment, and detailed description thereof will be omitted.

The first embodiment is provided with the high temperature side supply header 22 which supplies heating medium to the high temperature side flow passages 31*a* of the first high temperature layer 31 and the high temperature side flow passages 32*a* of the second high temperature layer 32. By contrast, the second embodiment has a structure in which heating medium is supplied from separate high temperature side supply headers 41 and 42, to the high temperature side flow passages 31*a* (33*a*) of the first high temperature layer 31 (the third high temperature layer 33) and the high temperature side flow passages 32*a* of the second high temperature layer 32.

Specifically, the stacked type fluid heater 10 according to the second embodiment comprises a first high temperature side supply header 41 which supplies heating medium to the plural number of high temperature side flow passages 31*a* of the first high temperature layer 31; a second high temperature side supply header 42 which supplies heating medium to the plural number of high temperature side flow passages 32*a* of the second high temperature layer 32; a first high temperature side assembler header 43 which merges the heating medium having flown through the plural number of high temperature side flow passages 31*a* of the first high temperature layer 31; and a second high temperature side assembler header 44 which merges the heating medium having flown through the plural number of high temperature side flow passages 32*a* of the second high temperature layer 32. Incidentally, the first high temperature side supply header 41 supplies the heating medium also to the plural number of high temperature side flow passages 33*a* of the third high temperature layer 33, and the first high temperature side assembler header 43 also merges the heating medium having flown through the plural number of high temperature side flow passages 33*a* of the third high temperature layer 33.

Figures 7A, 7B, 7C:
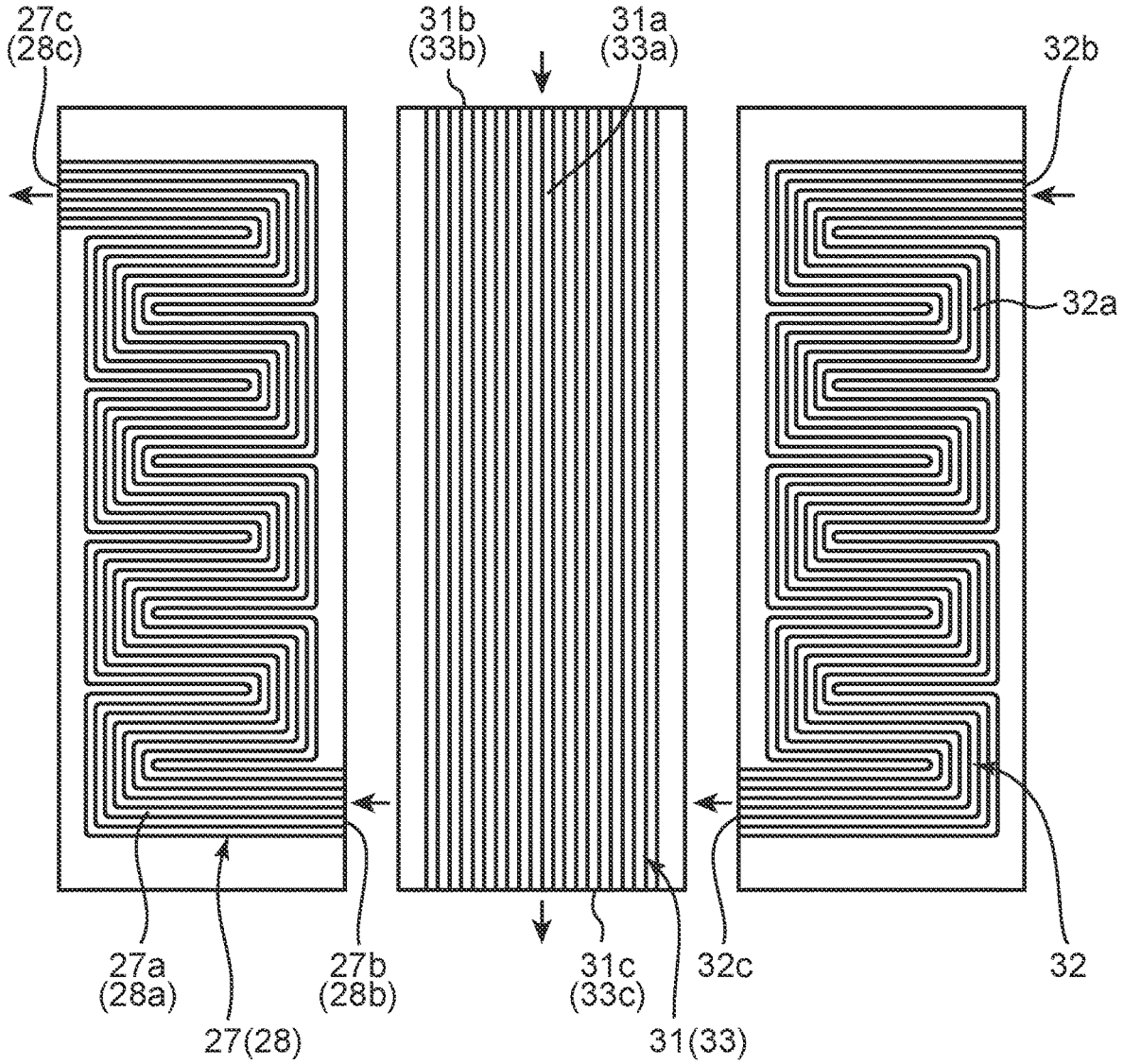
FIG. 7A is a diagram showing a structure of a metal plate for forming a first low temperature layer in the second embodiment of the present invention.
FIG. 7B is a diagram showing a structure of a metal plate for forming a first high temperature layer in the second embodiment of the present invention.
FIG. 7C is diagram showing a structure of a metal plate for forming a second high temperature layer in the second embodiment of the present invention.

Configuration of the low temperature side flow passages 27*a* and 28*a* of the low temperature layers may be the same configuration as in the first embodiment, as shown in FIG. 7A. Configuration of the high temperature side flow passages 31*a* of the first high temperature layer 31 may be the same configuration as in the first embodiment, as shown in FIG. 7B. In this case, configuration of the high temperature side flow passages 32*a* of the second high temperature layer 32 is different from that of the first embodiment. For example, as shown in FIG. 7C, the high temperature side flow passages 32*a* of the second high temperature layer 32 may be formed into a zigzag shape. Besides, the inlet 32*b* of the high temperature side flow passages 32*a* in the second high temperature layer 32 is provided at a position different from the inlet 31*b* (33*b*) of the high temperature side flow passages 31*a* (33*a*) in the first high temperature layer 31 (the third high temperature layer 33). Besides, the inlet 32*c* of the high temperature side flow passages 32*a* in the second high temperature layer 32 is provided at a position different from the inlet 31*c* (33*c*) of the high temperature side flow passages 31*a* (33*a*) in the first high temperature layer 31 (the third high temperature layer 33). The inlet 31*b* (33*b*) of the high temperature side flow passages 31*a* (33*a*) of the first high temperature layer 31 (the third high temperature layer 33) opens in the inner space of the first high temperature side supply header 41, and the outlet 31*c* (33*c*) of the high temperature side flow passages 31*a* (33*a*) of the first high temperature layer 31 (the third high temperature layer 33) opens in the inner space of the first high temperature side assembler header 43. The inlet 32*b* of the high temperature side flow passages 32*a* of the second high temperature layer 32 opens in the inner space of the second high temperature side supply header 42, and the outlet 32*c* of the high temperature side flow passages 32*a* of the second high temperature layer 32 opens in the inner space of the second high temperature side assembler header 44.

The stacked type fluid heater 10 comprises an adjustment unit 46 which adjusts supplying proportion to the first high temperature side supply header 41 and to the second high temperature side supply header 42. The adjustment unit 46 comprises a first state detection unit 46*a*, a second state detection unit 46*b*, and a flow amount adjustment unit 46. The first state detection unit 46*a* is configured to detect a differential pressure between a fluid pressure inside the first high temperature side supply header 41 and a fluid pressure inside the first high temperature side assembler header 43. The second state detection unit 46*b* is configured to detect a differential pressure between a fluid pressure inside the second high temperature side supply header 42 and a fluid pressure inside the second high temperature side assembler header 44. In place of the first state detection unit 46*a* and the second state detection unit 46*b*, a differential pressure gauge may be used. Alternatively, it is also possible to use a configuration of two pressure gauges and a comparator to take a differential pressure of the two pressure gauges. Incidentally, the first state detection unit 46*a* and the second state detection unit 46*b* are not limited to those detect differential pressure, but, for example, may be those configured to detect difference in temperature between a fluid temperature inside the first high temperature side assembler header 43 and a fluid temperature inside the first high temperature side assembler header 43.

A flow amount adjustment unit 46*c* is configured to adjust a supplying proportion to the first high temperature side supply header 41 and to the second high temperature side supply header 42, according to a result detected by the first state detection unit 46*a* and a result detected by the second state detection unit 46*b*. The flow amount adjustment unit 46*c* comprises a first flow amount adjustment valve 46*d* which adjusts flow amount of heating medium to be supplied to the first high temperature side supply header 41; and a second flow amount adjustment valve 46*e* which adjusts flow amount of heating medium to be supplied to the second high temperature side supply header 42. Incidentally, the flow amount adjustment unit 46*c* is not limited to those comprise two adjustment valves, but may comprise, for example, a three-direction valve.

According to the present embodiment, it is possible to adjust flow amount of heating medium to be supplied to the high temperature side flow passages 31*a* of the first high temperature layer 31 and flow amount of heating medium to be supplied to the high temperature side flow passages 32*a* of the second high temperature layer 32 with the flow amount adjustment unit 46. Accordingly, even in a case where a portion of heating medium is frozen, it is possible to continue operation of the stacked type fluid heater 10 by adjusting supplying amount to the high temperature side flow passages 31*a*, 32*a* and 33*a*, for example, on the basis of a pressure loss in the high temperature side flow passages 31*a*, 32*a* and 33*a*, or the like.

Incidentally, the other configurations, functions and effects are the same as in the first embodiment, and descriptions thereof will be omitted.

OTHER EMBODIMENTS

Figure 8:
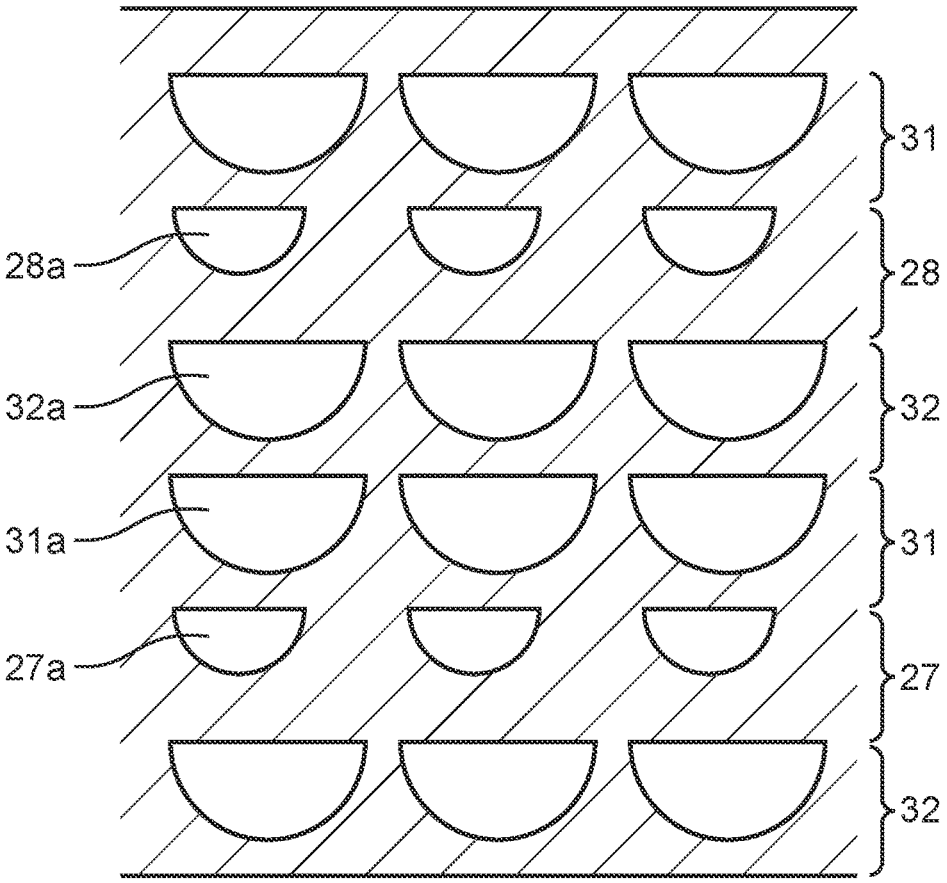
FIG. 8 is a sectional view of a main part of the laminate in a further embodiment of the present invention.

Incidentally, the present invention is not limited to the embodiments described above, and various modifications or improvements may be made in the scope not departing from the object of the present invention. For example, the first embodiment has a structure in which the first low temperature layer 27, the first high temperature layer 31, the second high temperature layer 32, the third high temperature layer 33 and the second low temperature layer 28 are adjacent one to the next, in this order. However, the structure is not limited thereto. For example, as shown in FIG. 8, the structure may be such that the first low temperature layer 27, the first high temperature layer 31, the second high temperature layer 32 and the second low temperature layer 28 are adjacent one to the next, in this order. In the structure of FIG. 8, the plural number of high temperature side flow passages 31*a* of the first high temperature layer 31 and the plural number of high temperature side flow passages 32*a* of the second high temperature layer 32 are adjacent to each other with a metal material, which is a component of the second high temperature layer 32, being interposed therebetween. In this connection, the plural number of high temperature side flow passages 31*a* of the first high temperature layer 31 and the plural number of high temperature side flow passages 32*a* of the second high temperature layer 32 should only be adjacent to each other through at least one of a metal material which is a component of the first high temperature layer 31 and a metal material which is a component of the second high temperature layer 32. In this manner, heat of heating medium flowing through the high temperature side flow passages 32*a* of the second high temperature layer 32 is transmitted to heating medium flowing through the high temperature side flow passages 31*a* of the first high temperature layer 31 adjacent thereto. In other words, a region between the high temperature side flow passages 31*a* of the first high temperature layer 31 and the high temperature side flow passages 32*a* of the second high temperature layer 32 easily maintains a high temperature, because the region is hard to be cooled with the target medium to be heated. Therefore, even if heating medium flowing through the high temperature side flow passages 31*a* of the first high temperature layer 31 is cooled with target medium to be heated in the low temperature side flow passages 27*a*, it is possible to heat the heating medium with the portion between the high temperature side flow passages 31*a* and 32*a* which maintains a high temperature. Thus, it is possible to inhibit heating medium from being frozen.

Figure 9:
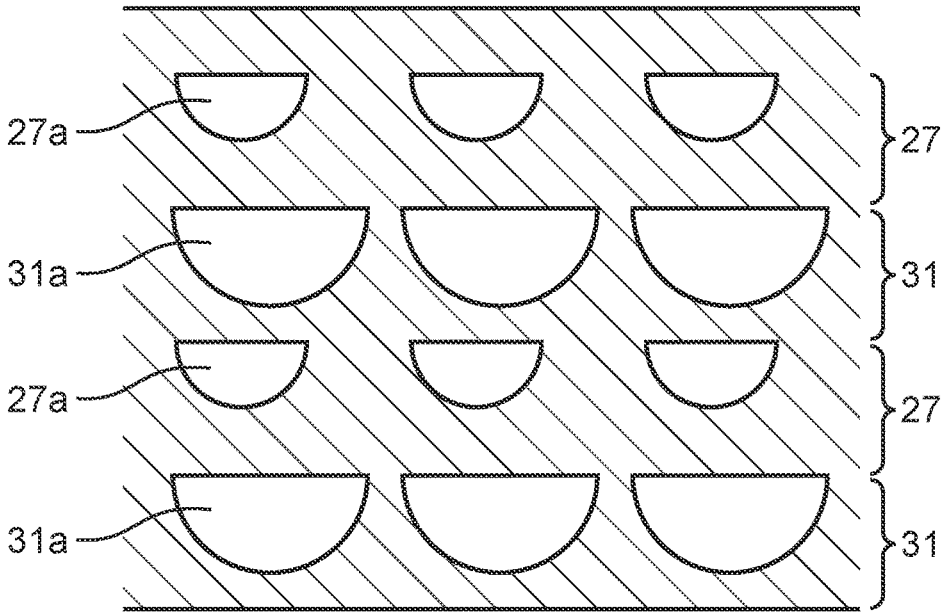
FIG. 9 is a sectional view of a main part of the laminate in a still further embodiment of the present invention.

As shown in FIG. 9, the structure may be such that the first low temperature layer 27 and the first high temperature layer 31 are adjacent to each other, in this order. Also in this case, the structure is such that the plural number of high temperature side flow passages 31*a* formed on the first high temperature layer 31 includes the high temperature side flow passages 31*a* adjacent to each other with a metal material which is a component of the first high temperature layer 31. This allows heat of heating medium flowing through a high temperature side flow passage 31*a* to be transmitted to heating medium flowing through a high temperature side flow passage 31*a* adjacent thereto, with a metal material which is a component of the first high temperature layer 31. That is, a region between the high temperature side flow passages 31*a* in a metal material which is a component of the first high temperature layer 31 easily maintains a high temperature.

What is claimed is:

1. A stacked type fluid heater comprising:

a first low temperature layer on which a plural number of low temperature side flow passages is formed to introduce therein target medium to be heated; and a first high temperature layer adjacent to the first low temperature layer, on which a plural number of high temperature side flow passages is formed to introduce therein heating medium for heating the target medium to be heated, wherein:

a temperature of the target medium to be heated introduced to the plural number of low temperature side flow passages is lower than a freezing point of the heating medium;

the plural number of high temperature side flow passages are arranged to be adjacent to one another through a component of the first high temperature layer; and further comprising:

a second high temperature layer adjacent to the first high temperature layer, on which a plural number of high temperature side flow passages is formed to introduce therein heating medium which is a same fluid as said heating medium to be introduced to the flow passages of the first high temperature layer;

the plural number of high temperature side flow passages of the first high temperature layer and the plural number of high temperature side flow passages of the second high temperature layer are arranged to be adjacent to one another through at least one of a component of the first high temperature layer and a component of the second high temperature layer;

a third high temperature layer adjacent to the second high temperature layer, on which a plural number of high temperature side flow passages is formed to introduce therein heating medium which is a same fluid as said heating medium to be introduced to the flow passages of the high temperature layer;

the plural number of high temperature side flow passages of the second high temperature layer and the plural number of high temperature side flow passages of the third high temperature layer are arranged to be adjacent to one another through at least one of a component of the second high temperature layer and a component of the third high temperature layer;

a second low temperature layer adjacent to the third high temperature layer, on which a plural number of low temperature side flow passages is formed to introduce therein target medium to be heated which is a same fluid as said target medium to be heated; and a high temperature side supply header that supplies heating medium into the plural number of high temperature side flow passages of the first high temperature layer, the plural number of high temperature side flow passages of the second high temperature layer, and the plural number of high temperature side flow passages of the third temperature layer;

wherein a thickness of the second high temperature layer is smaller than a thickness of the first high temperature layer and a thickness of the third high temperature layer and a cross sectional area of each of the high temperature side flow passages formed on the second high temperature layer is smaller than that of each of the high temperature side flow passages formed on the first high temperature layer and the third high temperature layer.

2. The stacked type fluid heater according to claim 1, wherein the second high temperature layer comprises a second low temperature layer laminated thereon, on which a plural number of low temperature side flow passages are formed to introduce therein target medium to be heated which is the same fluid as said target medium to be heated.

3. The stacked type fluid heater according to claim 1, wherein a temperature of the target medium to be heated to be introduced into the plural number of low temperature side flow passages is −40° C. or less.

* * * * *